US008875913B2

(12) United States Patent
Diaz

(10) Patent No.: US 8,875,913 B2
(45) Date of Patent: Nov. 4, 2014

(54) LUBRICIOUS, SEALED, AIRLESS BABY BOTTLE

(71) Applicant: Priska I. Diaz, Corona, NY (US)

(72) Inventor: Priska I. Diaz, Corona, NY (US)

( * ) Notice: Subject to any disclaimer, the term of this patent is extended or adjusted under 35 U.S.C. 154(b) by 0 days.

(21) Appl. No.: 13/815,802

(22) Filed: Mar. 15, 2013

(65) Prior Publication Data

US 2014/0263148 A1 Sep. 18, 2014

(51) Int. Cl.
*A61J 9/00* (2006.01)
*A61J 11/00* (2006.01)

(52) U.S. Cl.
CPC ..... *A61J 9/005* (2013.01); *A61J 11/006* (2013.01)
USPC ..... 215/11.1; 215/11.3; 215/11.6; 222/105; 222/326; 222/490; 220/304; 220/378

(58) Field of Classification Search
CPC ..... A61J 9/00; A61J 9/04; B65D 47/08
USPC ..... 215/11.1, 11.3, 11.6; 222/105, 326, 222/490; 220/304, 378
See application file for complete search history.

(56) References Cited

U.S. PATENT DOCUMENTS

| | | | |
|---|---|---|---|
| 2,208,360 | A | 7/1940 | Duerme |
| 2,898,007 | A | 8/1959 | Gassaway |
| 3,093,256 | A | 6/1963 | Woodbury, Jr. |
| 3,162,318 | A | 12/1964 | Woodbury, Jr. |
| 3,184,120 | A | 5/1965 | Undi |
| 4,010,861 | A | 3/1977 | Welten |
| 5,109,996 | A | 5/1992 | Sullivan |
| 6,138,848 | A | 10/2000 | Fermo |
| 6,871,751 | B2 | 3/2005 | Kerns et al. |
| 7,810,661 | B2 | 10/2010 | Murphy |

*Primary Examiner* — Elizabeth Volz
(74) *Attorney, Agent, or Firm* — The Law Firm of Andrea Hence Evans, LLC

(57) ABSTRACT

An airless baby bottle includes: a) an elongated shaft having an open top and an open bottom and having a constant internal cross-section, and having attachment means for securing a nipple piece fastening collar thereto; b) a nipple piece fastening collar; c) a nipple piece having a main body with an outer rim and having a nipple with at least one liquid-release orifice and nipple having a plurality of accordion segments so as to create a rest short nipple position and so as to permit a stressed elongated nipple position when a baby sucks on it; d) a piston to sealably and moveably fit within the elongated shaft, the piston having external sides with a peripheral upper blade and a peripheral lower blade, each of said peripheral upper blade peripheral lower blade having a plurality of peripheral ridges running perpendicular to the elongated shaft elongation direction.

10 Claims, 11 Drawing Sheets

LUBRICIOUS, SEALED, AIRLESS BABY BOTTLE

REFERENCE TO RELATED APPLICATION

The present application is a continuation-in-part application of U.S. patent application Ser. No. 13/066,896, filed by Priska I. Diaz on Apr. 28, 2011 titled "Airless Baby Bottle", which itself is continuation-in-part of provisional U.S. application Ser. No. 61/351,190 filed on Jun. 3, 2010 and titled "Baby Nurser", by Priska I. Diaz.

BACKGROUND OF INVENTION a. Field of Invention

The invention relates generally to a baby bottle that is directed to accomplish a plurality of preferred goals simultaneously. Specifically, the present invention baby bottle is directed to: elimination or very significant reduction of air in the containment area of the milk or other liquid (formula, milk substitute, juice, etc.) to very significantly reduce gas-creating air during feeding; simulation of real woman breast-nipple experience by providing a unique nipple extending feature during sucking; elimination of a milk bag or pouch; and the accomplishment of the foregoing with minimal, user friendly components. Preferred embodiments also provide the following additional benefits: (1) 100% air free to help prevent gas and gas associated effects from air ingestion; (2) allows user to expel air by pushing the piston from the bottom up; (3) helps retard milk oxidation to retain nutrients that are lost when milk comes in contact with air; (4) a nipple that is designed to mimic mother's breast (nipple stretches to double length during sucking to train baby proper latch and aids to stop mom's sore nipple); (5) leak-proof orifices dispense milk only upon suction to allow baby to control milk flow rate; (6) stops baby's backwash to keep milk fresher longer and healthier; (7) works on suction as opposed to gravity, so infants can feed in any angle to better support development of self-feeding and faster, more successful weaning. Further, there are included herein unique component features and materials of construction that create leak proof connections and functionality of the present invention devices.

b. Description of Related Art

The following patents are representative of the field pertaining to the present invention:

U.S. Pat. No. 7,810,661 B2 to Murphy describes a baby-bottle apparatus for holding dry feeding formula separate from water in the bottle prior to in-situ mixing at feeding time. It combines a bottle, open and threaded at both ends, a powder chamber with a sealable, removable lid, and a piston-like pusher for releasing the lid and mixing the powder and water.

U.S. Pat. No. 6,871,751 B2 to Kerns et al. discloses a baby bottle nipple, comprising a fastener including a sealing surface adapted to be fastened on a baby bottle, and a wall adapted to be contacted with a baby's mouth, the wall having at least one opening to allow milk to pass through, the wall including a nipple portion with the opening being provided in the nipple portion, wherein the wall is comprised of polyisoprene rubber made with a neodymium catalyst.

U.S. Pat. No. 5,109,996 to Sullivan describes a nursing bottle assembly of the type in which a collapsible liquid sack having an open end and a closed end and is contained in a protective tube open at both ends that is provided with a plunger for expelling air from a collapsing liquid containing sack. The open top end of the sack is clamped by a nipple-mounting cap to one end of the tube. The hollow cylindrical plunger can be inserted into the open end of the protective outer tube opposite its nipple-carrying end. Any time liquid is being or has been withdrawn from the sack, the plunger may be manipulated by manual pressure to compress the sack toward the nipple end of the tube to reduce the volumetric capacity of the sack between its closed end and the nipple to prevent any air from accumulating in the sack space vacated by the removed liquid.

U.S. Pat. No. 4,010,861 to Welten describes a nursing bottle consisting of a cylindrical tube of transparent material that has slightly enlarged end portions on which a suction nipple is secured at one enlarged end by means of a threaded cap and a one-way valve is secured by means of a similar cap at the other end. A slidable piston is designed and arranged inside the tube so as to move toward the nipple end of the bottle as the liquid in the bottle decreases.

U.S. Pat. No. 3,184,120 to K. Undi describes a device for dispensing fluids, comprising: a tube having a hollow body of deformable, dimensionally stable material, the tube having an outlet at its top end for the fluid dispensed and being closed at its lower end, the lower end being provided with an inlet for admitting air into the tube; and a plunger positioned within the tube beneath the fluid to be dispensed, the plunger having an annular top portion in close slidable sealing engagement with the inner wall of the tube and being provided with a resiliently flexible, flared, depending annular skirt having a peripheral dimension of the hollow body of the tube, the skirt being normally resiliently urged against the inner surface of the hollow body so as to make close sealing slidable fit within the hollow body of the tube, compression of the lower end of the tube beneath the plunger compressing the air confined within the tube so as to further urge the depending flexible skirt against the inner surface of the hollow body and to maintain intimate sealing engagement therewith while advancing the plunger upwardly of the tube and dispensing the fluid in the tube through the outlet.

U.S. Pat. No. 3,162,318 to C. R. Woodbury Jr. describes piston means having leading and trailing transverse elements spaced apart axially, each having a peripheral portion generally conical in shape and inclined in trailing direction, the peripheral portions being substantially equal in diameter and constituting the greatest diameter of the piston means.

U.S. Pat. No. 3,093,256 to C. R. Woodbury Jr. describes a baby food feeder of the character disclosed comprising a tubular body member having a uniformly cylindrical inner surface extending its full length with full diameter opening at both ends, the body member being adapted for containing a quantity of flowable food, a mouthpiece having an aperture therein detachably mounted on one end of the body member and forming an air seal therewith, the opposite end of the body member defining substantially the corresponding end of the device, and performed piston means in the body member insertable through the opposite end thereof and movable in leading direction in the body member toward food therein, the piston means including a pair of axially spaced transverse elements a leading one of which faces the food and engages the inner surface of the body member, the leading element including a central substantially planar main portion and a conical peripheral portion flexible relative to the central portion and inclined in trailing direction relative to the central portion, the leading element having a possible diameter greater than the body member due to the inclination of the peripheral portion and tendency to spreading toward planar position by friction between itself and the body member in movement thereof in trailing direction, thereby enabling movement of the piston means more easily in leading direction than in trailing direction, the trailing one of the elements having a portion substantially planar in form and a peripheral portion at least as far in trailing direction as the planar portion, the trailing element also at least closely approaching the inner surface of the body member in diameter and sufficiently spaced from the leading element as to be operative for maintaining the piston means in co-axial alignment with the body member in all positions along the body member, the position means being contained in axial direction between the respective front and rear surfaces of the leading and trailing elements, the piston means further being free of mechanical connection with all other parts of the feeder including the body member and movable without restriction, by other than food in the body member and contract friction with the body member, throughout the full length of the body member and thus movable substantially completely to the end of the device opposite the mouthpiece, the opposite end of the body member being freely vented to atmosphere.

U.S. Pat. No. 2,898,007 to B. F. Gassaway describes a dispensing device for viscous liquid materials comprising an elongated container of uniform cross-section throughout a substantial portion of its length having flexible and resilient side walls along its longitudinal dimension, a floating stiff plunger element free to traverse the longitudinal dimension of the container, the plunger element dividing the interior of the container into two compartments, each of the compartments being unobstructed across its entire transverse dimension, one adjacent each end of the container and each substantially sealed from the other, a valve controlled air inlet at one end of the container for introducing air into the compartment adjacent the one end, and a liquid dispensing spout at the other end of the container for discharging liquid from the other compartment, the liquid dispensing spout having an aperture extending therethrough communicating at its inner end with the other compartment and a valve structure having flexible and elastic wall elements for closing the aperture by constriction of a portion of the aperture, the valve structure accommodating unidirectional flow if liquid from the interior of the other compartment to the atmosphere, the aperture being the only passage leading from the interior of the other compartment to the atmosphere.

U.S. Pat. No. 2,208,360 to F. M. Duerme describes a nursing bottle comprising a unitary one-piece shell open at both ends, in combination with a collapsible pouch having a restricted neck portion and arranged to be inserted in the interior of the shell, and having its open end arranged to be stretched over one end of the shell to close the same and retain the body of the pouch within the shell, and a nursing nipple adapted to be stretched over the other end of the shell, all constructed and arranged to cause an even discharge flow of liquid in drops from the shell when the nipple is compressed and the shell inverted.

Notwithstanding the prior art, the present invention is neither taught nor rendered obvious thereby.

SUMMARY OF INVENTION

The present invention is directed to an airless baby bottle, which includes: a) a baby bottle elongated shaft having at least one side wall, an open top and an open bottom and having a constant internal cross-section from a top view, the open top having attachment means for securing a nipple piece fastening collar thereto; b) a nipple piece fastening collar being removably attachable to the open top of the elongated shaft and having a central orifice for holding the nipple piece; c) a nipple piece having a main body with an outer rim and having a nipple with at least one liquid-release orifice, the nipple of the nipple piece having a plurality of accordion segments so as to create a rest position that is a short nipple position and so as to permit a stressed position that is an elongated nipple position, wherein, when a baby sucks on the nipple with suction force of at least one hundred mm Hg, the nipple will elongate from the first position to the second position and upon release of the suction, will recover from the second position back to the first position the nipple further having a top view footprint outer perimeter consistent with the elongated tube open top so as to nest thereon and under the nipple piece fastening collar, wherein when the nipple piece is situated on the elongated tube open top and the nipple piece fastening collar is placed over it and fastened to the attachment means of the elongated tube open top, a liquid impermeable seal is established; d) a piston having top view footprint outer perimeter consistent with the elongated shaft internal cross-section so as to sealably and moveably fit within the open bottom of the elongated shaft. The piston has external sides with a peripheral upper blade and a peripheral lower blade, each of the peripheral upper blade peripheral lower blade has a plurality of peripheral ridges running perpendicular to the elongated shaft elongation direction. With this airless baby bottle, a user may place the piston (which acts as an air plug) in position from the bottom of the shaft; fill the shaft with liquid food; place the nipple-collar and securely attach it to the shaft neck; and then push the piston from bottom up to expel extra air so as to eliminate all air inside the shaft, and to provide a feeding capability with a simulation of real woman breast-nipple experience to a baby, wherein the nipple is extended and the piston moves upward toward the top as the baby sucks the liquid. Thus, milk or other liquid food is dispensed in the same manner that breasts do, and, in some preferred embodiments, through more than one angled orifice and only upon suction. The baby strength controls the flow rate. The tip of nipple extends inside baby's mouth upon suction just like a mother's breast.

In some preferred embodiments of the present invention airless baby bottle, the constant internal cross-section of the elongated shaft is circular. In other embodiments, the cross-section could be other than circular, such as oval, square, polygonal or even irregular, in which case, the attachment mechanism could be snap on or other mechanism rather than a screw-on.

In some preferred embodiments of the present invention airless baby bottle, the nipple accordion segments are located on the inside of the nipple to as to be externally hidden. In other embodiments, they may be on the outside or on both the inside and the outside.

In some preferred embodiments of the present invention airless baby bottle, the nipple piece and the nipple piece fastening collar are removably attachable separate components. In yet other embodiments, the nipple piece and the nipple piece fastening collar are permanently attached to one another.

In some preferred embodiments of the present invention airless baby bottle, the nipple smallest inside diameter at the accordion segments is at least 30% less than the nipple largest inside diameter at the accordion segments.

In some preferred embodiments of the present invention airless baby bottle, the nipple is a silicone nipple. In some of these preferred embodiments, the silicone nipple lines the inside of the attachment collar so that milk never touches the material of the collar, e.g., plastic.

In some preferred embodiments of the present invention airless baby bottle, the piston external blades are composed of a material that includes a blend of an elastomer, polypropylene and a siloxane.

In some preferred embodiments of the present invention airless baby bottle, the piston external blades have at least three ridges on each blade.

In some preferred embodiments of the present invention airless baby bottle, the shaft includes an elastomeric grip component at its bottom.

In a different version of the present invention wherein the piston moves down rather than up as the milk or other liquid is consumed, the airless baby bottle, which includes: a) a baby bottle elongated shaft having at least one side wall, an open top and a closed bottom and having a constant internal cross-section from a top view, the open top having attachment means for securing a nipple piece fastening collar thereto; b) a nipple piece fastening collar being removably attachable to the open top of the elongated shaft and having a central orifice for holding the nipple piece; c) a nipple piece having a main body with an outer rim and having a nipple with at least one liquid-release orifice, the nipple of the nipple piece having a plurality of accordion segments so as to create a rest position that is a short nipple position and so as to permit a stressed position that is an elongated nipple position, wherein, when a baby sucks on the nipple with suction force of at least one hundred mm Hg, the nipple will elongate from the first position to the second position and upon release of the suction, will recover from the second position back to the first position the nipple further having a top view footprint outer perimeter consistent with the elongated tube open top so as to nest thereon and under the nipple piece fastening collar, wherein when the nipple piece is situated on the elongated tube open top and the nipple piece fastening collar is placed over it and fastened to the attachment means of the elongated tube open top, a liquid impermeable seal is established; d) a piston having a feed orifice thereon and having a top view footprint outer perimeter consistent with the elongated shaft internal cross-section so as to sealably and moveably fit within the open bottom of the elongated shaft; the piston has external sides with a peripheral upper blade and a peripheral lower blade, each of the peripheral upper blade peripheral lower blade has a plurality of peripheral ridges running perpendicular to the elongated shaft elongation direction; e) a flexible feed tube connected to the piston feed orifice at one end and removably connected to the nipple at an opposite end; f) a bottom sealing cover for attachment to the open bottom of the shaft. With this airless baby bottle, a user may fill the closed bottomed shaft with the desired level of liquid, insert the piston with the tube in the upright position to the top of the liquid to expel all air, connect the opposite end of the tube to the nipple, affix the nipple piece and the nipple piece fastening collar to the open top of the shaft to provide a feeding with a simulation of real woman breast-nipple experience to a baby, wherein the nipple is extended and the piston moves down toward the bottom as the baby sucks the liquid, and to further provide a feeding capability that does not require inversion of the bottle for feeding.

In some preferred embodiments of the present invention airless baby bottle with the piston moving down as the liquid is consumed, the constant internal cross-section of the elongated shaft is circular.

In some preferred embodiments of the present invention airless baby bottle with the piston moving down as the liquid is consumed, the nipple accordion segments are located on the inside of the nipple to as to be externally hidden.

In some preferred embodiments of the present invention airless baby bottle with the piston moving down as the liquid is consumed, the nipple piece and the nipple piece fastening collar are removably attachable separate components.

In some preferred embodiments of the present invention airless baby bottle with the piston moving down as the liquid is consumed, the nipple piece and the nipple piece fastening collar are permanently attached to one another.

In some preferred embodiments of the present invention airless baby bottle with the piston moving down as the liquid is consumed, the nipple smallest inside diameter at the accordion segments is at least 30% less than the nipple largest inside diameter at the accordion segments.

In some preferred embodiments of the present invention airless baby bottle with the piston moving down as the liquid is consumed, the nipple is a silicone nipple.

In some preferred embodiments of the present invention airless baby bottle with the piston moving down as the liquid is consumed, the piston is made of at least one component, and wherein at least said piston external blades are composed of a material that includes a blend of an elastomer, polypropylene and a siloxane.

In some preferred embodiments of the present invention airless baby bottle with the piston moving down as the liquid is consumed, the piston external blades have at least three ridges on each blade.

In some preferred embodiments of the present invention airless baby bottle with the piston moving down as the liquid is consumed, the shaft includes an elastomeric grip component at its bottom.

In some preferred embodiments of the present invention airless baby bottle with the piston moving down as the liquid is consumed, any of the optional features and components described above for the embodiments wherein the piston moves upward as the liquid is consumed, may be employed.

For any embodiment of the present invention, other detailed, useful features may be included. These would include pulls inside and/or outside the pistons to enhance ease of removal; and a burping mechanism, such as an air release valve, for the piston to allow initial air between the filled liquid and the piston to escape during initial set up and prior to baby's use (this closes the gap between the milk and the piston or the milk and the end opposite the piston to further make the bottle airless during use). Burping valves, also known as air release valves, allow air to escape, but not liquids.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
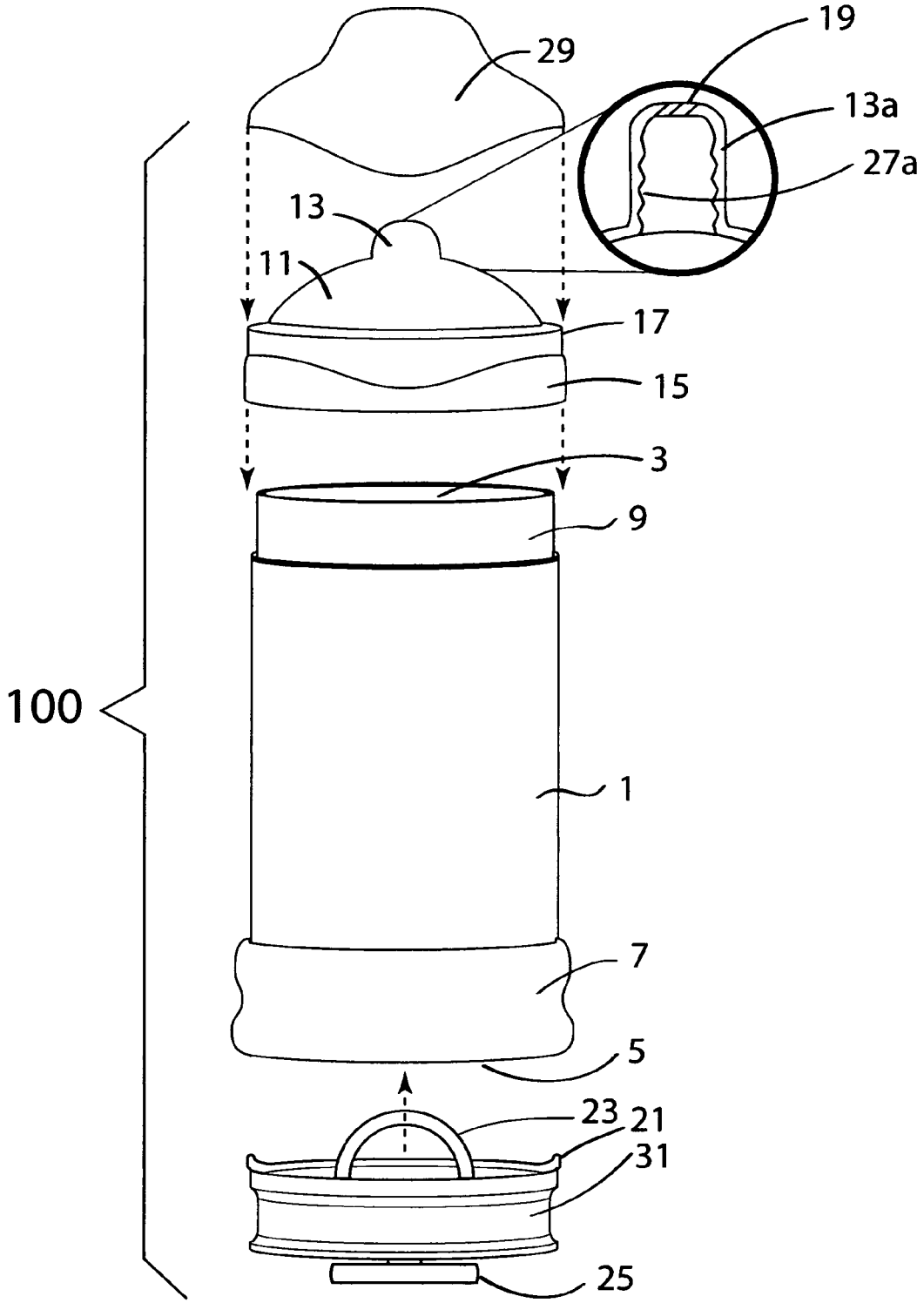
FIG. 1 illustrates front, perspective exploded view of one embodiment of the present invention airless baby bottle as set forth in the co-pending parent patent application of which this is a continuation in part.

Referring now in detail to the drawings wherein like reference numerals designate corresponding parts throughout the several views, various embodiments of the present invention are shown.

The 'plunger' (piston) on the present invention airless baby bottle has piston external sides with a peripheral upper blade and a peripheral lower blade, each of the peripheral upper blade and the peripheral lower blade having a plurality of peripheral ridges running perpendicular to the elongated shaft elongation direction, i.e. the piston has two opposing blades that each have multiple ridges. These blades and their ridges move up and down the inside of the bottle main elongated shaft to create a super seal to prevent leakage during use. Further, in most preferred embodiments, the blades are constructed a unique formulated blend of several materials to be both structural and flexible to create ideal water-tight seals and yet slippery enough to easily overcome friction created by the seal. They are polypropylene, at least one elastomer, and a lubricious imputing constituent, such as a siloxane or similar compound.

In some of those most preferred embodiments mentioned above, at least the blades of the piston are made from a plastic formula of about 1.0% to about 40% percent of a propylene-based elastomer (such as Vistamaxx® by Exxon Mobil), about 5% to about 20% siloxane or similar lubricity-enhancing material, and about 40% to about 85% polypropylene to increase flexibility. One formulation involves a custom blend of FDA approved material. The preferred constituent to reduce the coefficient of friction is siloxane, which is highly lubricious. The preferred polypropylene is one designed to have high heat resistance and thus is designed for thin wall molding. One such propylene is HP-544 PP (manufactured by HMC Polymers), a polypropylene homopolymer resin for thin wall injection, which has higher heat resistance and is better suited for molding thin wall designs.

Various composition blends were developed with the new piston design to specifically work with the new blend of materials, which includes the thin, symmetrical concave walls with concentric ridges. A mold for the new piston was created and molded pistons were made with several different ratios of polypropylene, Vistamaxx elastomer and siloxane (dimethyl siloxane, dimethyl vinyl terminated, from Dow Corning Chemical Co.). Piston performance was tested using vacuum equipment.

Optimized piston material blend based on test results are as follows:

20%~30% Vistamaxx (or a material like Vistamaxx);

8%~12% Siloxane (or a material like Siloxane);

58%~72% HP544 PP (Polypropylene Homopolymer Resin for Thin Wall Injection) (or a material with specs of HP544 (Polypropylene Homopolymer Resin for Thin Wall Injection)).

Furthermore, in some preferred embodiments, the coefficient of friction between the piston and the bottle shaft could be reduced further if the Siloxane is added to the bottle's main elongated shaft formulation at about 1% to about 5% plus PP (Polypropylene) ratio.

The following discussion of FIGS. 1 through 8 are taken from the parent case cited above, of which this is a continuation in part. These aspects are necessarily repeated for a clear understanding of the present invention. After the FIGS. 1 through 8 are present immediately below, the changes constituting the new structural aspects of the present invention are discussed in conjunction with FIGS. 9 through 14 are discussed.

FIG. 1 illustrates front, perspective exploded view of one embodiment of the present invention airless baby bottle 100. Baby bottle 100 includes a main elongated shaft 1. Shaft 1 is circular in this embodiment but may have a different internal and/or external shape, such as an oval, a square with rounded corners, or other configuration. The shaft 1 may be made of any functional material but it is preferably clear or translucent, at least in part, so that liquid level may be easily discerned. Shaft 1 may be made of glass or plastic and plastic such as polyethylene, polypropylene, or nylon may be used. Elongated shaft 1 has an open top 3 and an open bottom 5. It has an internal cross section that is constant (except for a small, slightly widened bottom piston entry portion). The shaft 1 has an attachment means at its open top 3. The attachment means may be a threaded area, a snap on receiver or other attachment means. In this embodiment, shaft 1 has a recessed external area 9 for force fit of a fastening collar. Shaft 1 also has an optional but preferred grip component 7 at its bottom 5. This grip component 7 is preferably an elastomeric grip component.

A nipple piece fastening collar 17 is adapted to fit over and secure nipple piece 11. Fastening collar 17 is then fitted on to recessed external area 9. Nipple piece 11 may have an outer rim that is vertical or horizontal. (These are shown respectively in FIGS. 2 and 5.) Nipple piece 11 simulates a real woman's breast nipple by having accordion segments that enable nipple 13 to stretch and release milk or other liquid when the baby is sucking on it. In this embodiment, the nipple piece 11 and the nipple piece-fastening collar 17 are preferably permanently connected to one another, but alternatively could be removably connectable. An optional protective cap 29 is also shown and is used to protect the nipple when not in use.

The insert of FIG. 1 shows details as follows: the insert shows the stretched nipple 13A with one or more liquid release opening(s) 19. Fastening collar 17 may optionally, but preferably include a gripping component such as grip 15 to enhance attachment and removal of the nipple piece 11 and fastening collar 17.

Piston 21 is a disk adapted to fit into shaft 1. It includes a sealing ring 31 that may be made of a silicone to enhance the sealing yet permit sliding, as described below. Alternatively or additionally, the piston 21 is preferably made of nylon and can be internally or completely coated, molded or co-molded, with silicone. Piston 21 has optional pull rings or handles 23 and 25 for pulling it up through shaft 1 or down through shaft 1 when disassembling for cleaning, as well as to distort it or alternatively, to temporarily open an air release valve, to effect a burping air removal so that the piston comes into direct contact with the milk before the bottle is used by a baby. With this airless baby bottle, a user may place the piston 21 (which acts as an air plug) in position from the bottom of the shaft 1; fill the shaft 1 with liquid food; place the nipple piece 11 and collar 17 on, and securely attach it to, the shaft neck; and then push the piston 21 from bottom up, to expel extra air so as to eliminate all air inside the shaft 1, and to provide a feeding capability with a simulation of real woman breast-nipple experience to a baby, wherein the nipple 13 is extended and the piston 21 moves upward toward the top as the baby sucks the liquid. Thus, milk or other liquid food is dispensed in the same manner that breasts do, and, in some preferred embodiments, through more than one angled orifice and only upon suction. The baby strength controls the flow rate. The tip of nipple extends inside baby's mouth upon suction just like a mother's breast.

Figure 2:
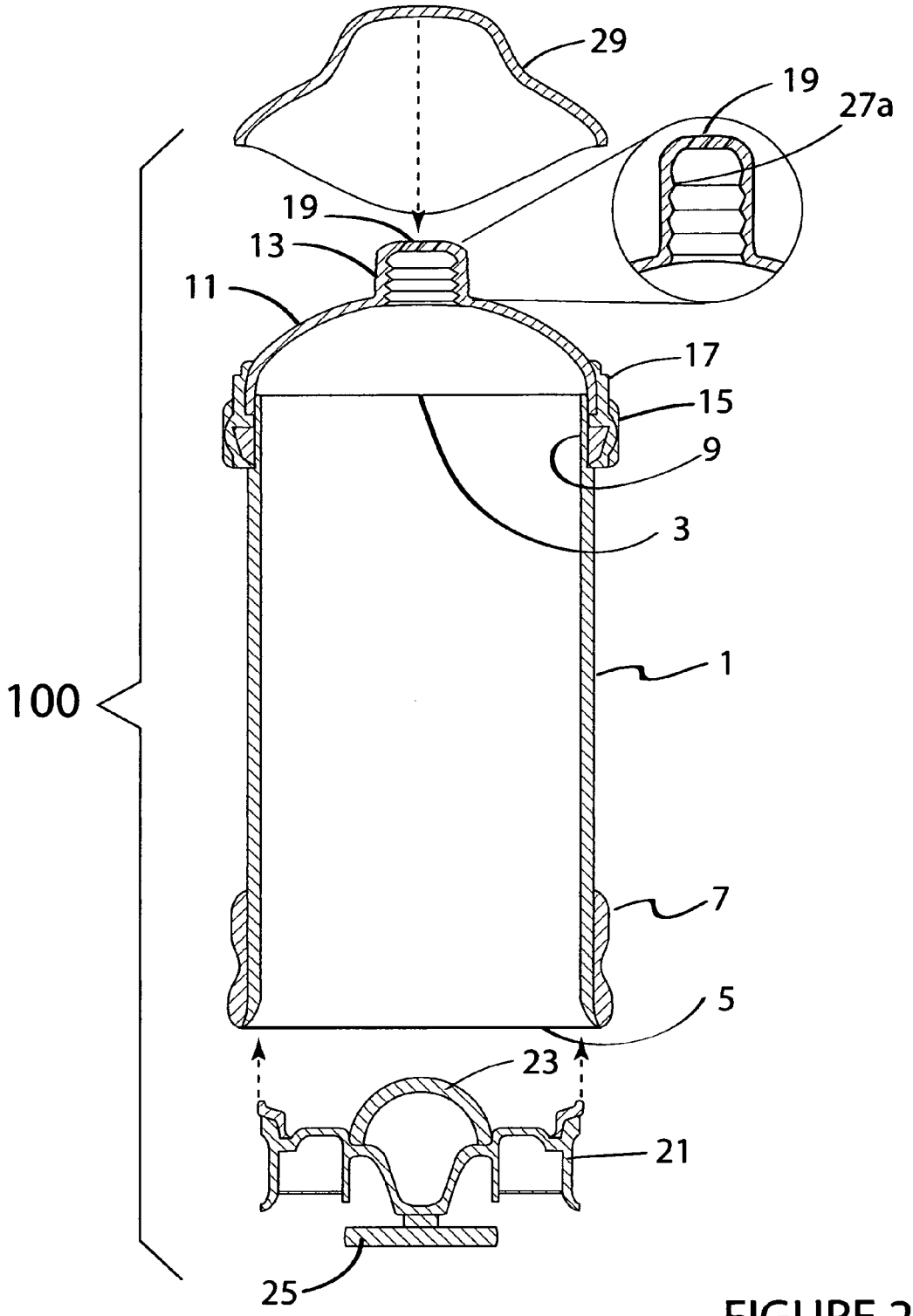
FIG. 2 illustrates a cut view of the present invention airless baby shown in FIG. 1.
Figure 3:
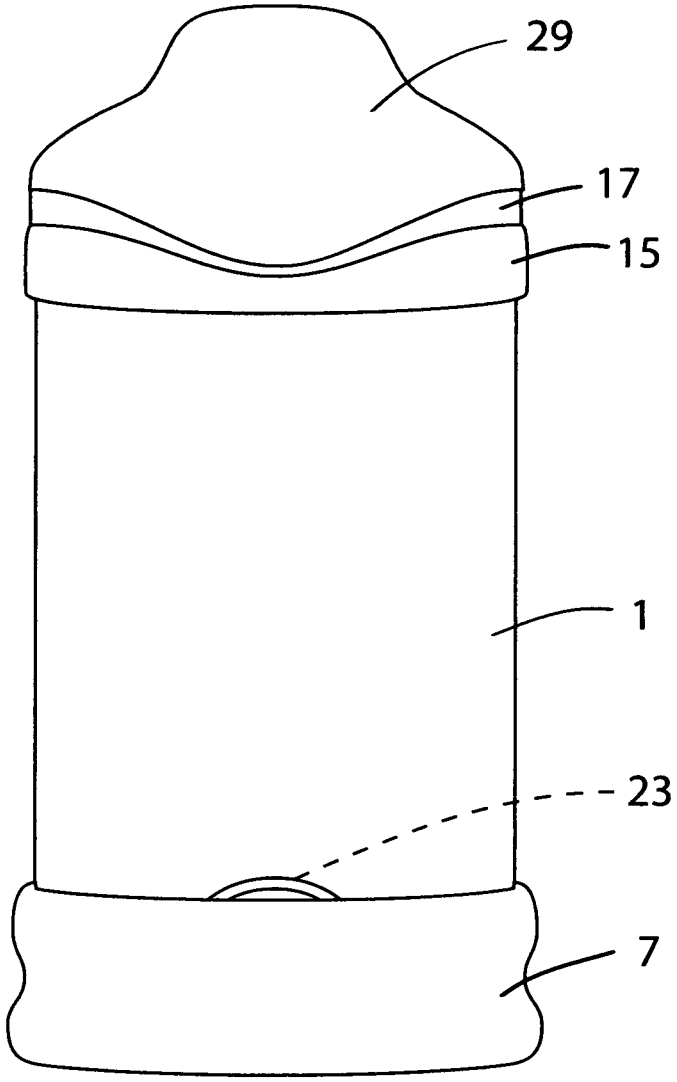
FIG. 3 illustrates a front view of the assembled, capped present invention airless baby bottle shown in FIGS. 1 and 2.

FIG. 2 illustrates a cut view of the present invention airless baby shown in FIG. 1 and FIG. 3 illustrates a front view of the assembled, capped present invention airless baby bottle 100 shown in FIGS. 1 and 2. Both FIGS. 2 and 3 have numbers identical to those of FIG. 1 and show further details of this present invention airless baby bottle.

Figure 4:
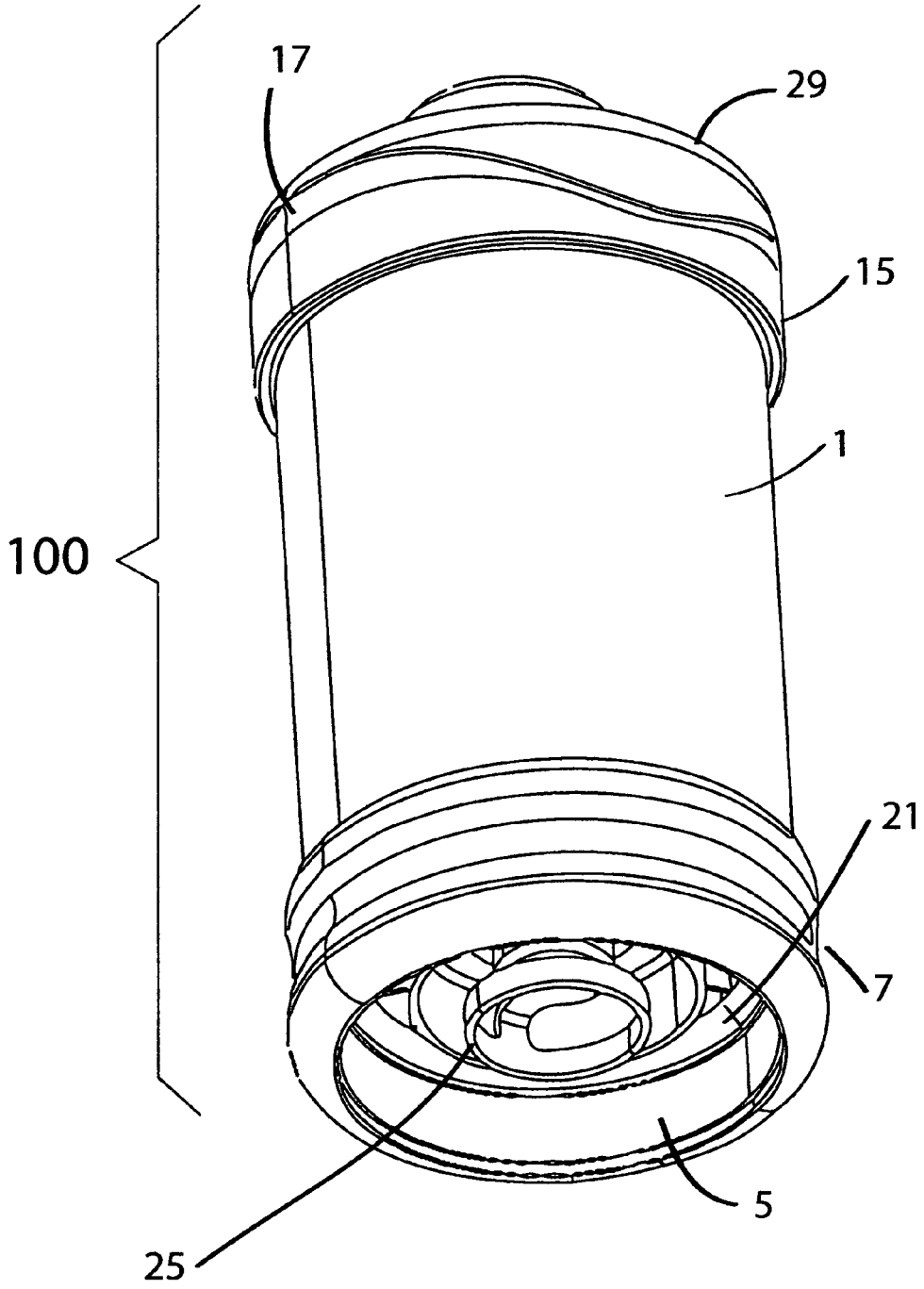
FIG. 4 illustrates a bottom oblique view of the capped, assembled airless baby bottle as set forth in the co-pending parent patent application of which this is a continuation in part.

FIG. 4 illustrates a bottom oblique view of the capped, assembled airless baby bottle 100, showing details of the now inserted piston 21.

Figure 5:
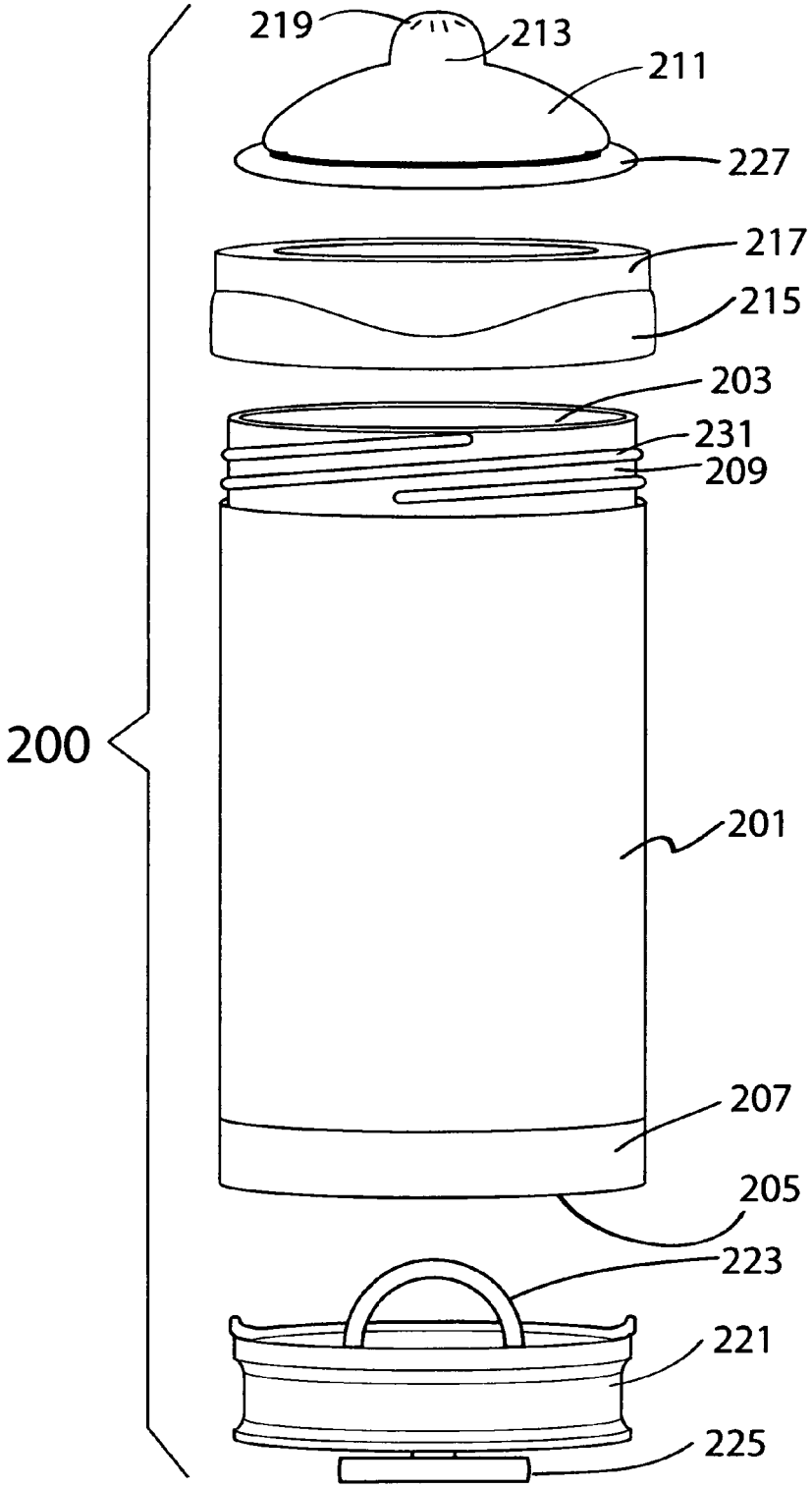
FIG. 5 illustrates a front perspective exploded view of an alternative embodiment present invention airless baby bottle as set forth in the co-pending parent patent application of which this is a continuation in part.

FIG. 5 illustrates a front perspective exploded view of an alternative embodiment present invention airless baby bottle 200. The Figure does not show an optional cap. Bottle 200 has an elongated shaft 201, with a circular sidewall, an open top 203 and an open bottom 205. The shaft 201 has a grip component 207 at or neat the bottom 205. There is a nipple piece 211 with a main body, a nipple 213, a nipple feed orifice 219 and a rim 227. Nipple piece fastening collar 217 fits over nipple piece 211 and via threading attaches to threads 231 of recessed area 209 of shaft 201. Piston 221 with internal pull 223 and external pull 225 is inserted into shaft 201 in the same manner as described in conjunction with the preceding drawings. With this airless baby bottle 200, a user may function in a fashion described above regarding the previous figures. To wit, a user may place the piston (which acts as an air plug) in position from the bottom of the shaft; fill the shaft with liquid food; place the nipple-collar and securely attach it to the shaft neck; and then push the piston from bottom up to expel extra air so as to eliminate all air inside the shaft, and to provide a feeding capability with a simulation of real woman breast-nipple experience to a baby, wherein the nipple is extended and the piston moves upward toward the top as the baby sucks the liquid. Thus, milk or other liquid food is dispensed in the same manner that breasts do, and, in some preferred embodiments, through more than one angled orifice and only upon suction. The baby strength controls the flow rate. The tip of nipple extends inside baby's mouth upon suction just like a mother's breast.

Figure 6:
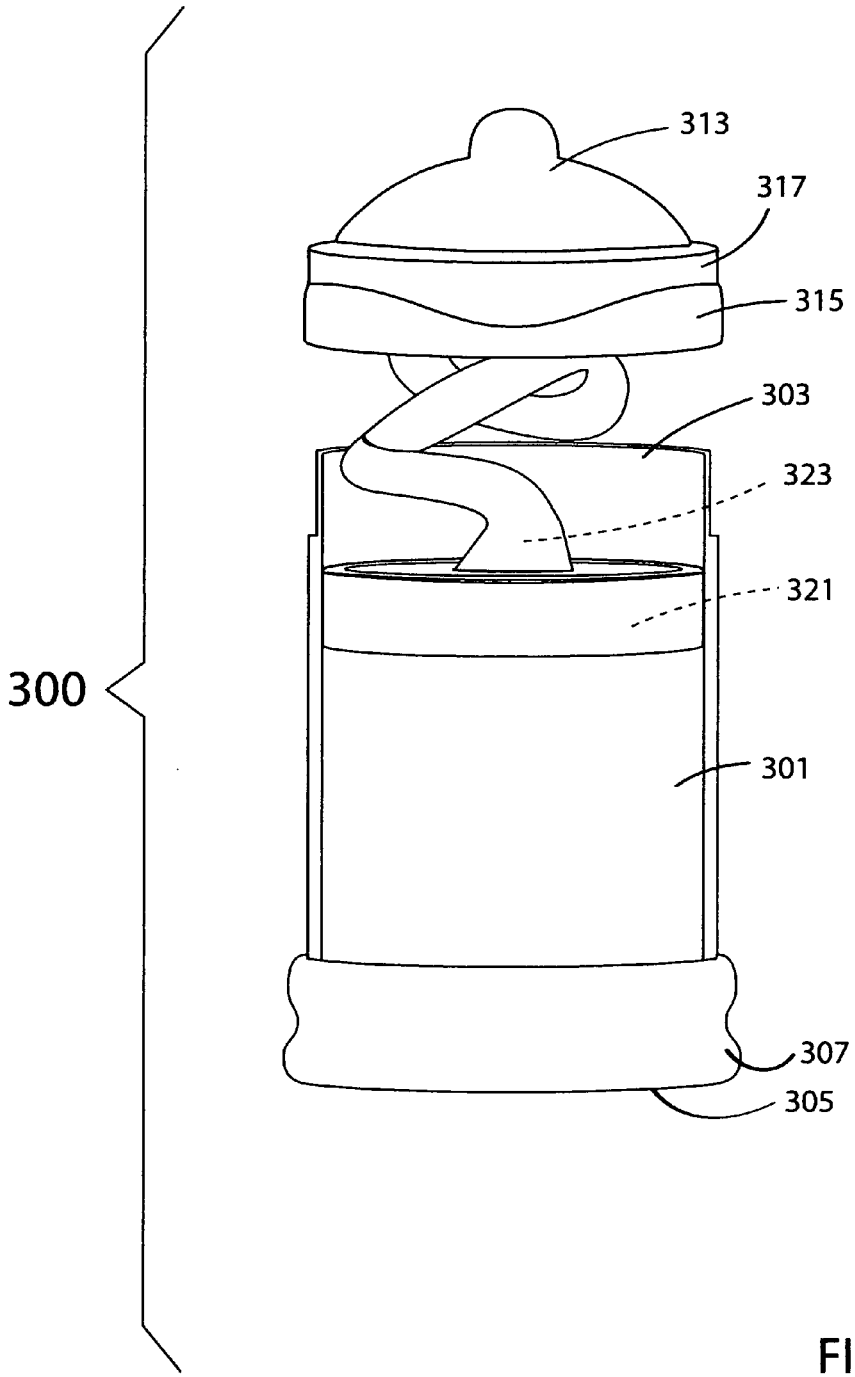
FIG. 6 illustrates another alternative embodiment present invention airless baby bottle utilizing a flexible tube feed line as set forth in the co-pending parent patent application of which this is a continuation in part.

FIG. 6 illustrates another alternative embodiment present invention airless baby bottle 300 utilizing a flexible tube feed line. This is similar to the previous embodiments, except that it is set up to have the piston travel down away from the nipple as the milk is consumed instead of traveling upward as previously described. Bottle 300 has an elongated shaft 301, with a circular sidewall, an open top 303 and an open bottom 305. The shaft 301 has a grip component 307 at or neat the bottom 305. There is a nipple piece with a main body and a nipple 313 with a nipple feed orifice attached to nipple piece fastening collar 317. Nipple piece fastening collar 317 fits onto the top 303 of shaft 301 and has a grip component 315, as shown. Piston 321 is located within shaft 301 toward its top and has an upwardly extending feed tube 323 that connects at a first end to the piston 321, as shown, and has a second end attached to nipple 313. There is a bottom cover (not shown), that fits onto the bottom 305 of shaft 301. Alternatively, the bottom may be molded as an integral portion of the shaft.

With this airless baby bottle 300 shown in FIG. 6, a user may fill the closed bottomed shaft with the desired level of liquid, insert the piston with the tube in the upright position to the top of the liquid to expel all air, connect the opposite end of the tube to the nipple, affix the nipple piece and the nipple piece fastening collar to the open top of the shaft to provide a feeding with a simulation of real woman breast-nipple experience to a baby, wherein the nipple is extended and the piston moves down toward the bottom as the baby sucks the liquid, and to further provide a feeding capability that does not require inversion of the bottle for feeding. In this embodiment, the tube-connecting portion of the nipple piece may be rigid or semi-rigid, to assist in securing the tube to the nipple.

Figure 7:
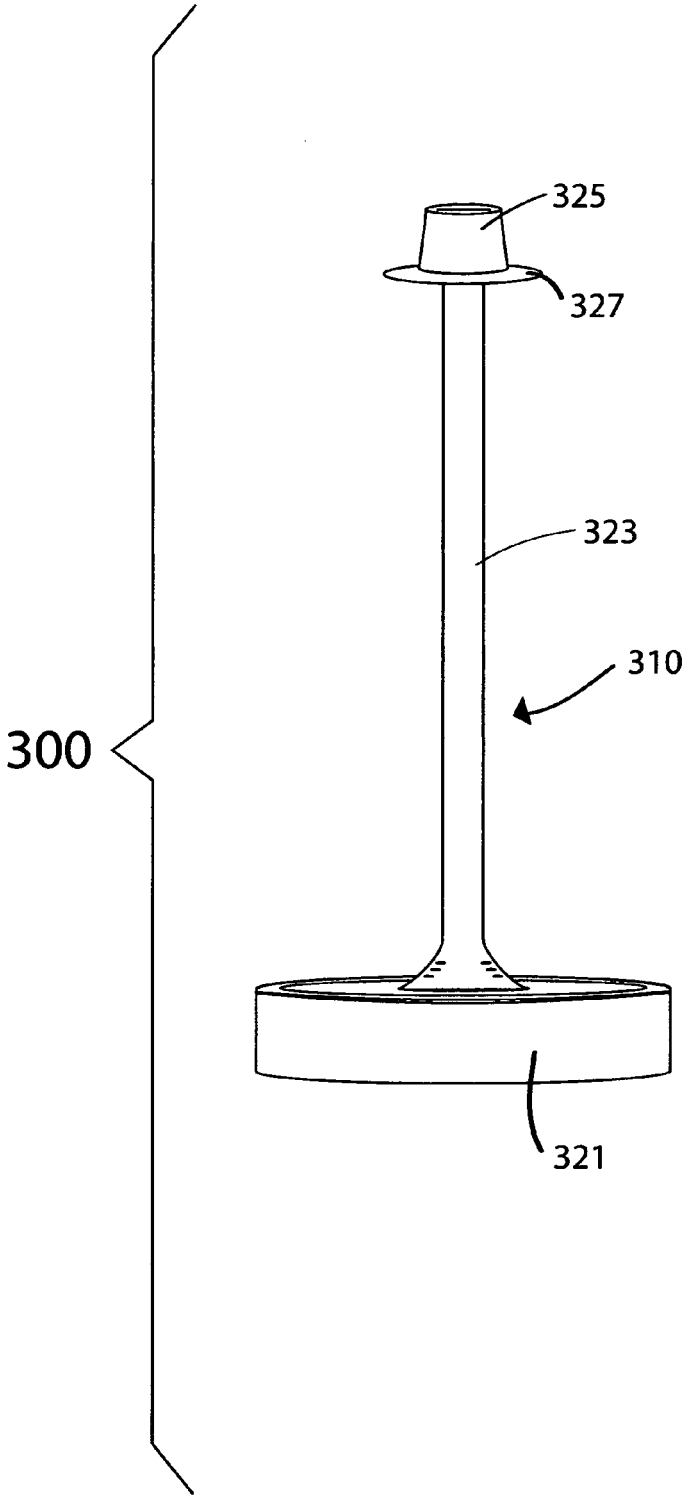
FIG. 7 illustrates a piston, flexible tube feed line and nipple joint that may be utilized in the present invention airless baby bottle of FIG. 6.

FIG. 7 illustrates a piston 321 and the flexible tube feed line 323 of FIG. 6 in its fully extended position, and also illustrates nipple joint 325 with flange 327 that may be utilized in the present invention airless baby bottle of FIG. 6 for attachment to the nipple 313.

Figure 8:
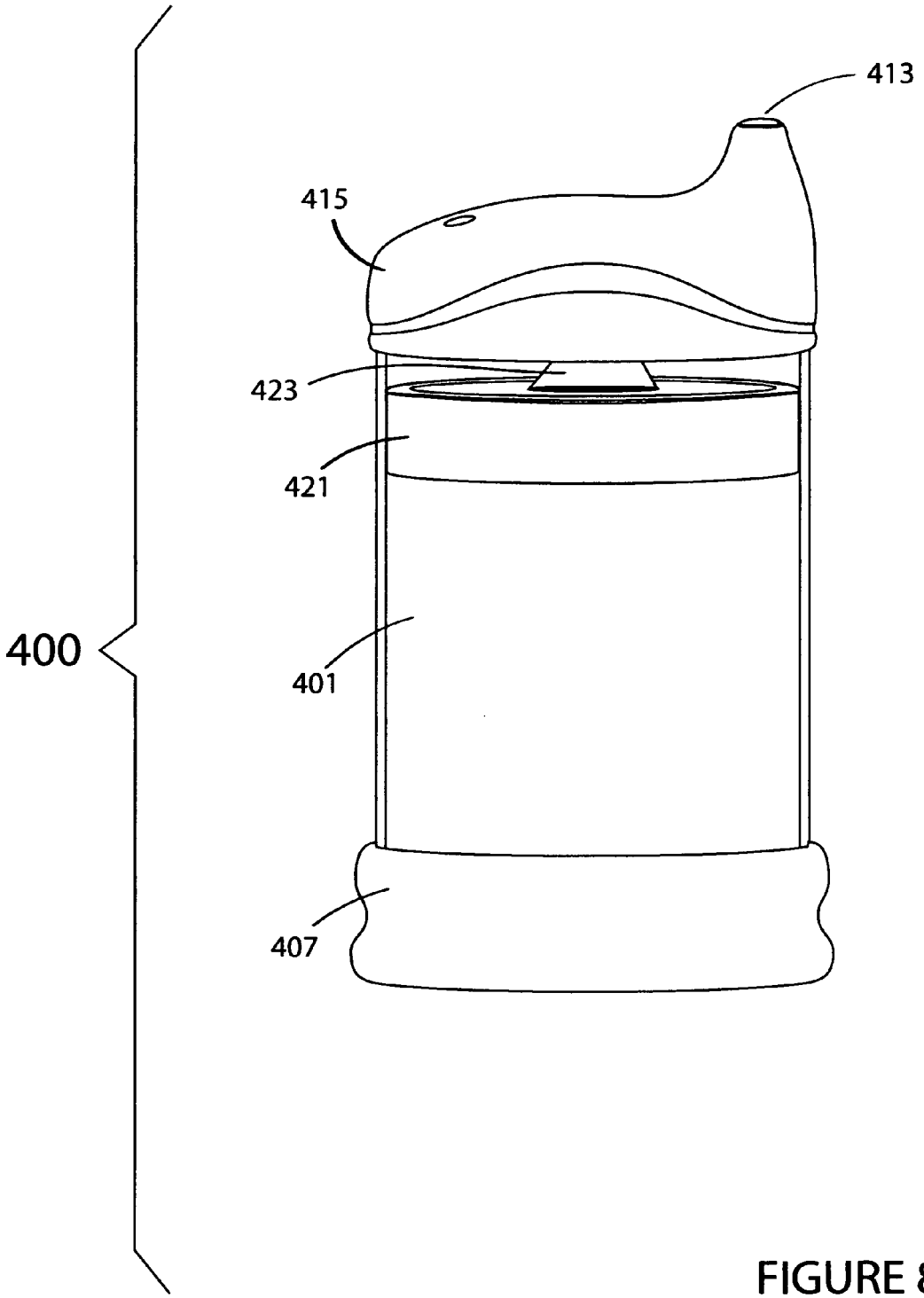
FIG. 8 is similar to the present invention arrangement shown in FIG. 6, but includes an alternative, offcenter dispensing nipple instead of a centered nipple to create a sip cup as set forth in the co-pending parent patent application of which this is a continuation in part.

FIG. 8 is similar to the present invention arrangement shown in FIG. 6, but is a different embodiment, showing present invention baby bottle 400 that includes an alternative, offcenter dispensing nipple 413 instead of a centered nipple to create a sip cup. It also has an elongated shaft 401, a piston 421 and flexible feeding tube 423 like the ones of FIGS. 6 and 7 above and a bottom grip 407 with a bottom cover (hidden from view). Except for the offset dispensing mechanism (nipple 413), this bottle 400 is connected together and functions in the same manner as bottle 300 of the previous FIG. 6.

Referring now to FIGS. 9 through 14 collectively, the improved piston 500 for the above described baby bottle is shown. It should be understood that piston 500, described below, replaces any and all pistons in all baby bottle embodiments set forth above. As to piston 500 set forth below, variations may be implemented without exceeding the scope of the present invention. These include the top peripheral shape, which would be the shape of any baby bottle into which it is installed, the handles and dome designs, the number of ridges and the like.

Figure 9:
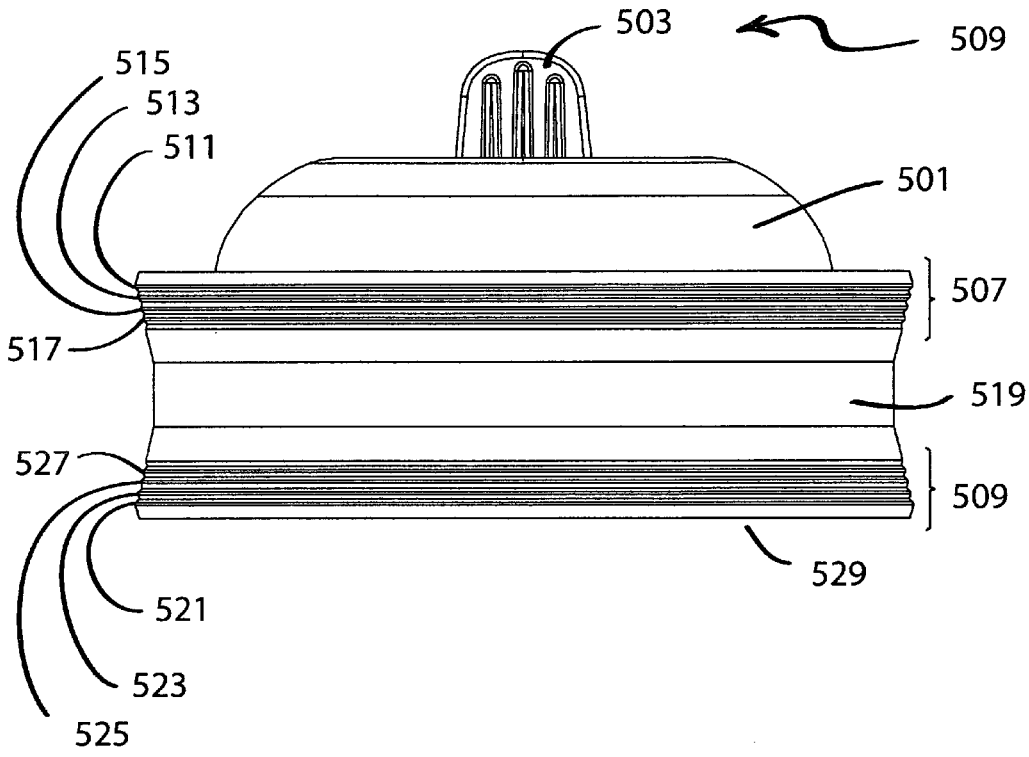
FIG. 9 illustrates a front view of the improved present invention baby bottle piston for the above described baby bottles set forth in the previous drawings and replacing the pistons set forth therein.

FIG. 9 illustrates a front view of present invention baby bottle piston 500. It includes a top 501, in this case a dome, a bottom 529 and sidewalls with upper wiper blade 507 and lower wiper blade 509 for engagement against the inside surface of a baby bottle elongated shaft. Each of the upper and lower wiper blades 507 and 509 have a plurality of ridges. In this particular configuration, upper wiper blade 507 includes ridges 511, 513, 515 and 517, with groves therebetween, as shown. Likewise, lower wiper blade 509 has ridges 521, 523, 525 and 527. Further, these wiper blades extend outwardly on a thin support band 519 shown in FIG. 10.

Figure 10:
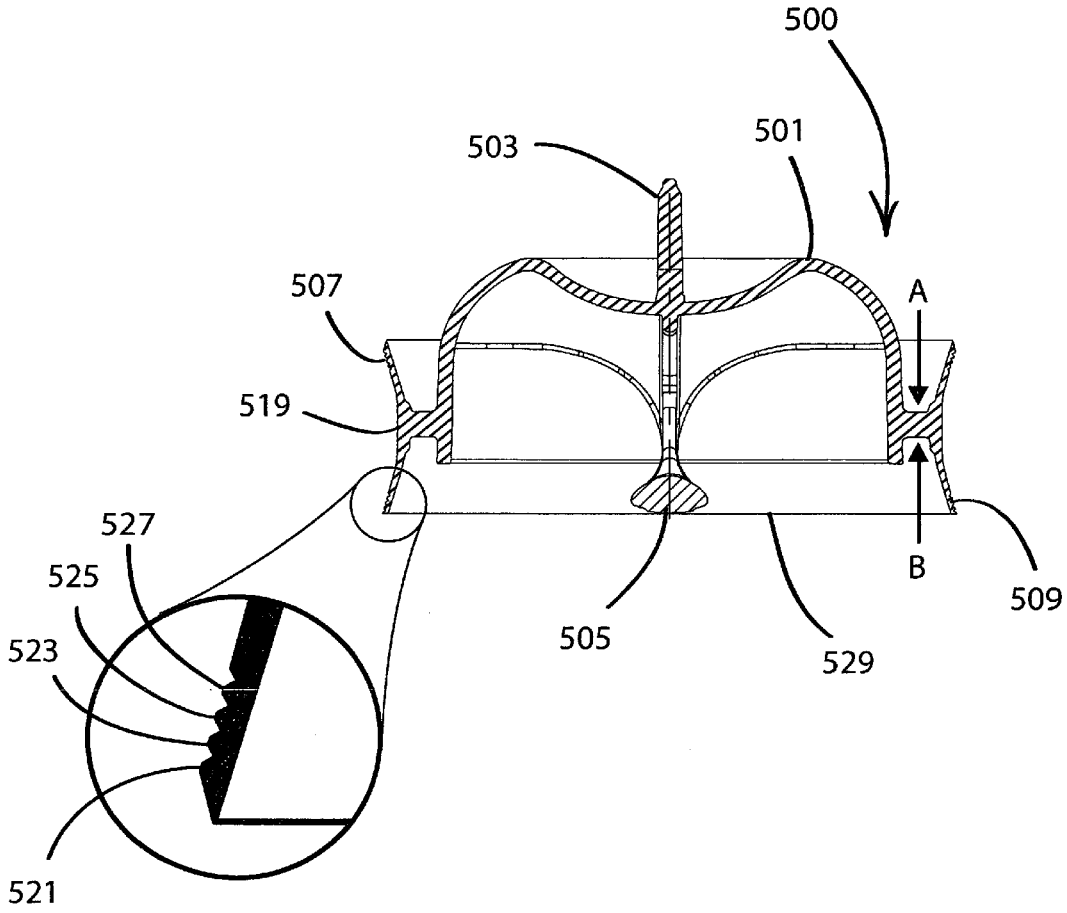
FIG. 10 illustrates a cut side view of the FIG. 9 piston with wiper blade details.

FIG. 10 illustrates a cut side view of present invention baby bottle piston 500 with wiper blade details. In this cut Figure, it can be seen that band 519 extends outwardly from dome 501 and has a horizontal thin outcrop as shown between arrows A and B in FIG. 10. Directly below handle 503 located on the top, is pull ring 505 located at the bottom. Handle 503 can be used to remove the piston 500 from one end of a baby bottle elongated shaft (typically the top) and pull ring 505 can be used to remove the piston 500 from the other end of a baby bottle elongated shaft, e.g., a bottom. Other components shown in FIG. 10, as well as those shown in FIGS. 11, 12 and 13 that are identical to those components in FIG. 9, are identically numbered and need not be repeatedly elaborated on. The circular inset of FIG. 10 is a blow up of the ridges of lower wiper blade 509.

Figure 11:
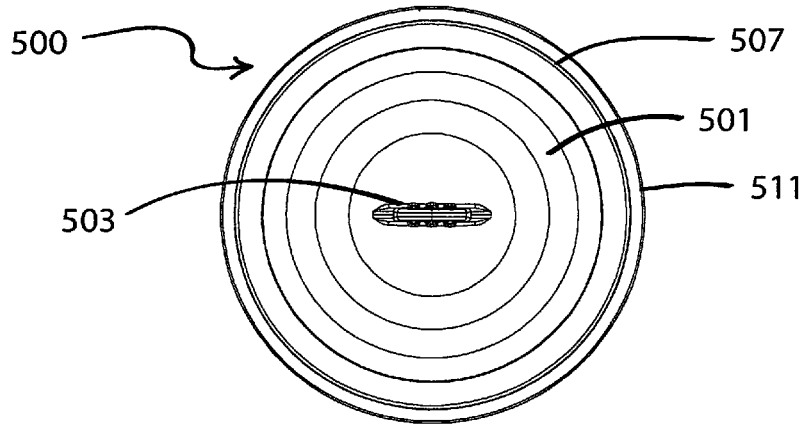
FIG. 11 shows top view of the present invention piston of FIG. 9.

FIG. 11 shows top view of the present invention piston 500 of FIG. 9.

Figure 12:
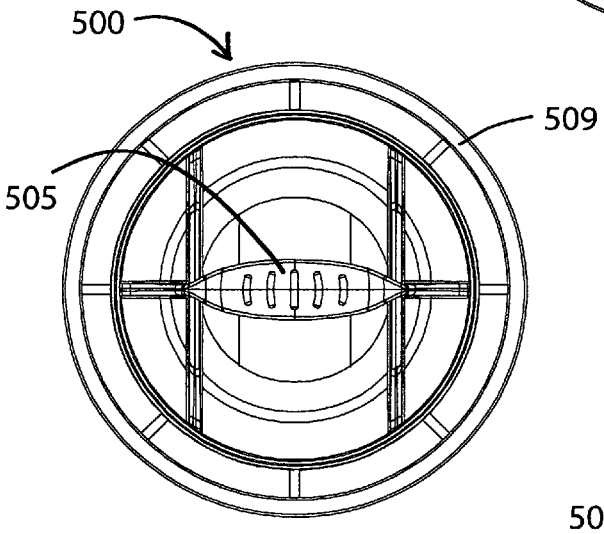
FIG. 12 illustrates a bottom view thereof.
Figure 13:
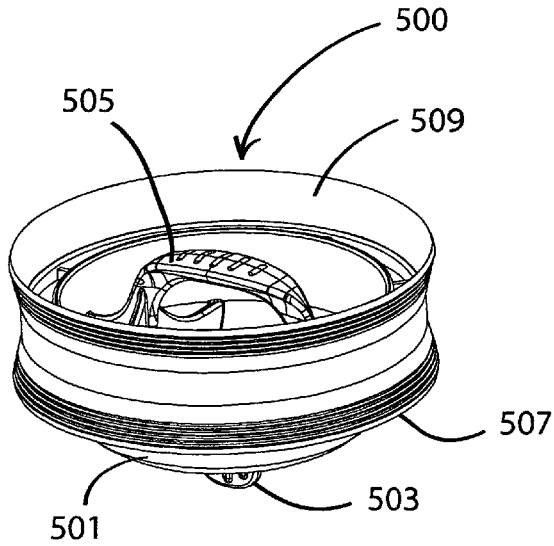
FIG. 13 shows an oblique bottom view thereof, more fully showing the bottom pull ring (handle).

FIG. 12 illustrates a bottom view of piston 500, illustrating pull ring 505 and cross support walls for pull ring 505. Likewise, FIG. 13 shows an oblique bottom view of piston 500, more fully showing the details of bottom pull ring 505.

The piston of FIGS. 9 through 13 may be constructed of preferred materials described above and will generally result in zero leakage over extended use as an important component of the present invention baby bottle.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, the embodiments that include a downwardly travelling piston with a feed tube, such as are shown in FIGS. 6, 7 and 8, may include separate components for the piston and feed tube, or, alternatively, the piston and feed tube may be a single molded component.

What is claimed is:

1. An airless baby bottle, which comprises:

a) a baby bottle elongated shaft having at least one side wall, an open top and an open bottom and having a constant internal cross-section from a top view, said open top having attachment means for securing a nipple piece fastening collar thereto;

b) the nipple piece fastening collar being removably attachable to said open top of said elongated shaft and having a central orifice for holding a nipple piece;

c) the nipple piece having a main body with an outer rim and having a nipple with at least one liquid-release orifice, said nipple further having a top view footprint outer perimeter so as to nest thereon and under said nipple piece fastening collar, wherein when said nipple piece is situated on an elongated tube open top and said nipple piece fastening collar is placed over it and fastened to said attachment means of said elongated tube open top, a liquid impermeable seal is established; and, d) a piston having top view footprint outer perimeter consistent with said elongated shaft internal cross-section so as to sealably and moveably fit within said open bottom of said elongated shaft, said piston having external sides with a peripheral upper blade and a peripheral lower blade, each of said peripheral upper blade peripheral lower blade having a plurality of peripheral ridges running perpendicular to said elongated shaft elongation direction;

wherein a user may place the piston in position from the bottom of the shaft; fill the shaft with liquid food; place the nipple-collar and securely attach it to the shaft; and then push the piston from bottom up to expel extra air so as to eliminate all air inside the shaft, and to provide a feeding capability wherein said piston shall move upwardly through suction caused by a suction force at said nipple.

2. The airless baby bottle of claim 1 wherein said constant internal cross-section of said elongated shaft has a shape selected from the group consisting of circular, oval, square and polygonal.

3. The airless baby bottle of claim 1 wherein said nipple includes a central liquid-release orifice and a plurality of non-central liquid-release orifices.

4. The airless baby bottle of claim 1 wherein said nipple piece and said nipple piece fastening collar are removably attachable separate components.

5. The airless baby bottle of claim 1 wherein said nipple piece and said nipple piece fastening collar are permanently attached to one another.

6. The airless baby bottle of claim 1 wherein said nipple is a stretchable nipple that will move away from said nipple piece fastening collar upon suction force of at least twenty five mm Hg.

7. The airless baby bottle of claim 1 wherein said nipple is selected from the group consisting, of silicone, latex, elastomer and combinations thereof.

8. The airless baby bottle of claim 1 wherein said shaft includes an elastomeric grip component at its bottom.

9. The airless baby bottle of claim 1 wherein at least said peripheral upper blades and peripheral lower blades are composed of as material that includes a blend of an elastomer, polypropylene and a siloxane.

10. The airless baby bottle of claim 9 wherein said peripheral upper blades and peripheral lower blades have at least three ridges on each blade.

* * * * *